United States Patent [19]

Picton

[11] 4,151,944

[45] May 1, 1979

[54] STAPLERS

[75] Inventor: Stewart D. Picton, Milton Keynes, England

[73] Assignee: Xerox Corporation, Stamford, Conn.

[21] Appl. No.: 837,133

[22] Filed: Sep. 28, 1977

[30] Foreign Application Priority Data

Mar. 31, 1977 [GB] United Kingdom ..... 13614/77

[51] Int. Cl.[2] ..... B27F 7/24
[52] U.S. Cl. ..... 227/120
[58] Field of Search ..... 227/120

[56] References Cited

U.S. PATENT DOCUMENTS

| | | | |
|---|---|---|---|
| 3,189,220 | 6/1965 | Mullaney | 227/120 X |
| 3,266,696 | 8/1966 | Tyszkiewicz | 227/120 |
| 3,622,061 | 11/1971 | Hoyer et al. | 227/120 |

*Primary Examiner*—Gerald A. Dost
*Assistant Examiner*—Paul A. Bell
*Attorney, Agent, or Firm*—J. J. Ralabate; C. A. Green; H. Fleischer

[57] ABSTRACT

A stapler including a driver, a magazine for sticks of staples, and a staple feeder for feeding staple sticks from the magazine to the driver and biasing the stick into position for stapling, said feeder comprising an endless belt arranged frictionally to engage the crown of a said stick and means for driving the belt.

6 Claims, 6 Drawing Figures

STAPLERS

This invention relates to staplers and more particularly to mechanisms for feeding staples.

Power operated staplers are well known and take various forms. Generally, however, they comprise a driver and some means for reciprocating the driver in a drive track. Staples in the form of sticks or strips of detachably joined staples held together by an adhesive are fed to the drive track, usually along a staple rail, and sequentially severed from the stick during the driving operation to drive the staple into a workpiece, e.g. stack of papers. In order to increase the staple capacity of the stapler, a magazine may be provided which holds several staple sticks, the staple feeder being arranged to accept sticks from the magazine.

It will be understood that for effective operation of the stapler, the staple feeder must, at least during operation of the stapler, feed the staple stick in such a way that it advances stepwise as each staple is severed from its leading end. This is most easily achieved by biasing the stick into position for stapling. Conventionally a spring loaded slide is engaged against the rear end of the stick. With such an arrangement, however, the slide must be retracted while a new stick is loaded with the result that the stapler must be stopped during reloading. With the aim of providing a staple feeder which avoids the necessity of stopping to reload, it has been proposed (see U.S. Pat. No. 3189220) to advance the staples using a friction roller engaging the crown of the staple stick. While such an arrangement indeed permits reloading without stopping, a separate mechanism acting in conjunction with the roller is required to feed the next staple stick to the roller.

It is an object of this invention to provide a simplified staple feeder which performs both these functions by means of a single device.

To this end, the invention provides a stapler including a driver, a magazine for sticks of staples and a staple feeder for feeding staple sticks from said magazine to the driver and biasing the stick into position for stapling, said feeder comprising an endless belt arranged frictionally to engage the crown of a said stick and means for driving the belt.

If the force applied by the staple feeder in the feed direction is too high, the stick may buckle or skew resulting in misfeeding. The force applied in the feed direction may be limited in one or both of the following ways. The first is to arrange that the belt will slide on a staple stick while biasing the stick into stapling position. This may be achieved by suitable control of the frictional force between the belt and staple stick. The second way is to provide in the belt drive, force limiting means whereby the belt will stall while continuing to bias the stick into stapling position. This may be achieved by a slip clutch in the belt drive or by the use of an impedance limited motor, that is a motor which will stall in a steady state condition in readiness for continued operation when the stall force is removed.

The drive to the belt may be intermittent, for example by means of a motor which is actuated each time a staple is driven but maintains the biasing force on the staple stick when switched off, e.g. by being connected through a one-way clutch.

The belt may also be driven off the driver by providing a drive connection between the driver and belt such that for each operation of the driver, the belt is indexed by an amount at least sufficient to position the next staple beneath the driver.

Advantageously, the staple stick is advanced to the driver along a rail on which the inside of the staple crown rests with the staple legs embracing the rail, and the belt engages the outside face of the crown. However, the staple stick may be supported in other ways and the belt may engage the inside face of the staple crown.

Where the stapler is adapted for crowned staples, the crown-engaging face of the belt may be matched to the profile of the crown.

The belt may be made of any material, reinforced if necessary, capable of exerting the necessary frictional force on the staples and is suitably made of a natural or synthetic elastomer such as nitrile, butyl or polyurethane elastomer. A reinforced belt may be formed of rubberized fabric. The belt may have a smooth crown-engaging surface or this surface may be roughened. The belt may have flexible surface projections; for example, it may be provided with hard-wearing bristles or it may be moulded with integral nodules on its surface.

In order that the invention may be more readily understood, reference will now be made to the accompanying drawings, in which.

Figure 1:
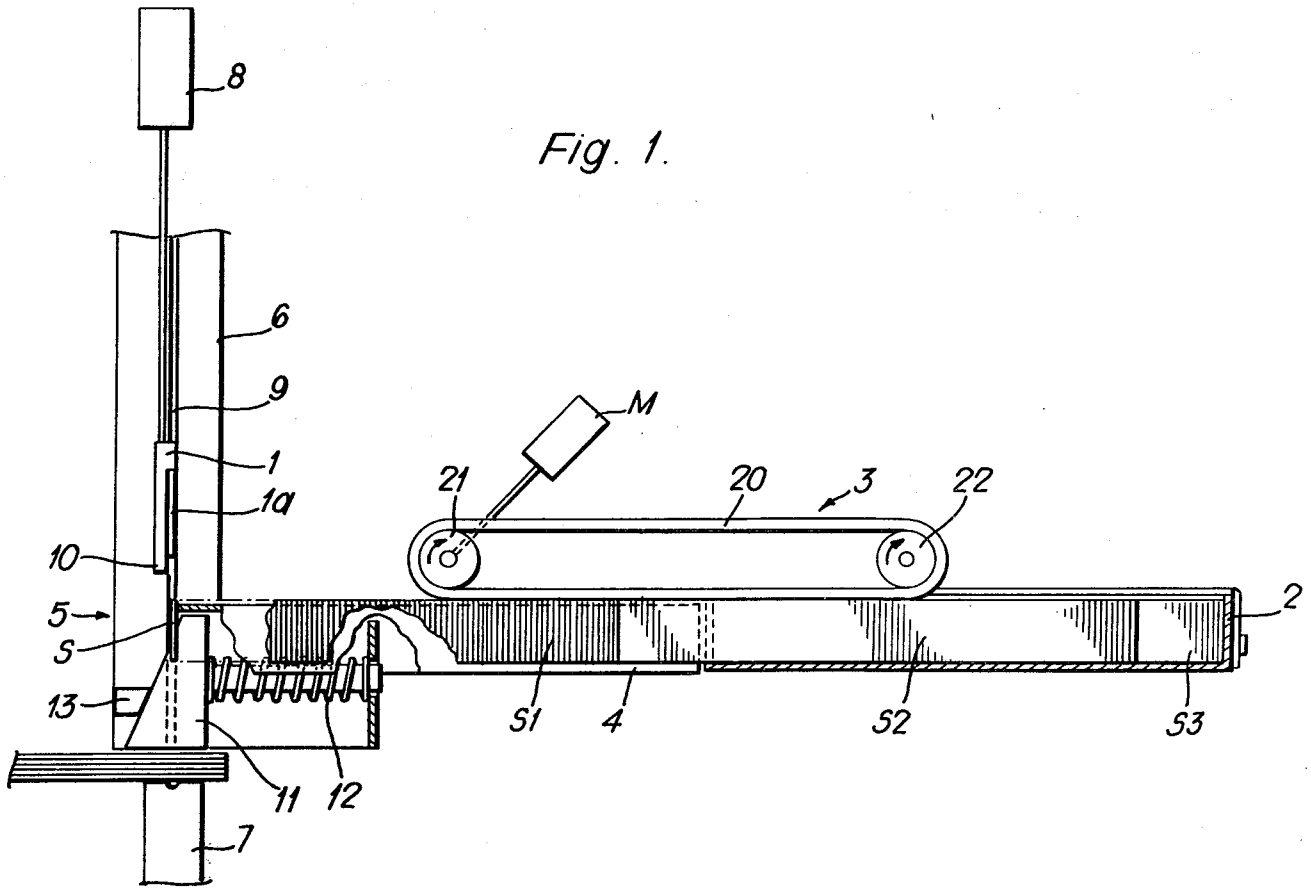
FIG. 1 is a schematic sectional view of one embodiment of power-operated stapler according to the invention.

Referring to the drawings, FIG. 1 illustrates a power-operated stapler in accordance with this invention. The stapler may be manually operated or operate automatically, for example in response to the delivery of a document set or signature thereto. In one particular form the stapler may be incorporated in finishing apparatus for stapling document sets produced by a photocopier.

The stapler includes a driver 1, a magazine 2 for sticks of staples S and a staple feeder mechanism generally indicated at 3 for feeding the staples from the magazine 2 to the driver 1 along a staple rail 4 and for biasing the staples into position beneath the driver for stapling. The driver is mouned in a stapler head 5 between a pair of side plates 6, only one of which is seen in FIG. 1. The staples S are successively driven downwards out of the stapler head by the driver 1 which reciprocates vertically. In order to turn over the staple legs once they have past through a document set, a staple clinch 7, which may be of the active or passive type, both of which are well known in the art, is provided opposite the stapler head. The driver 1 may be reciprocated by any suitable drive means 8 which, as illustrated, may be of the pneumatically operated type, examples of which are well known in the art.

Figure 2:
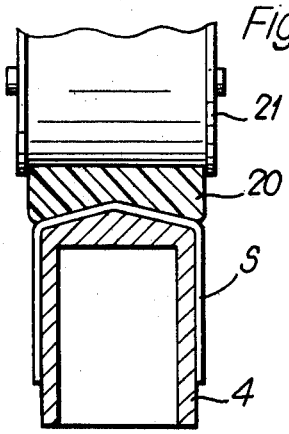
FIG. 2 is a cross-sectional view of the staple feeder of the stapler shown on FIG. 1.

The staple driver 1 has wings **1*a* which slide in channels 9 (only one of which is seen in FIG. 1) in the stapler head side plates 6. The staple S to be driven is held with its legs in alignment with the guide channels 9 by a shoulder 10 on the driver 1. The staples are of the kind having a raised crown, so-called crowned staples, as seen better in FIGS. 2 and 3. As compressed air is delivered to the pneumatic drive cylinder 8, the driver 1 moves downwards from the rest position shown. Initially, the staple crown is flattened causing the staple legs to be splayed into the guide channels 9. Continued downward movement of the driver slides the staple downwards with its legs constrained in the channels 9 and the crown engaged in a slot formed between the drive shoulder 10 and the end of the staple rail 4**.

A shoe 11 having a front face angled with respect to the driver supports the staple legs against inward bending. The shoe is biased to the left in FIG. 1 by a compression spring 12 and its movement is limited by a restraint 13 on the head side plates 6. As the staple is driven downwards, the driver shoulder 10 engages the front face of the shoe 11 so that the latter is progressively forced into a recess beneath the staple rail. The shoe serves to close the open inner sides of the guide channels 9 and ensures that the staple legs are fully restrained from bending movement.

The staple feeding mechanism 3 of this invention shown in FIG. 1 comprises an endless belt 20 which extends over guide rollers 21, 22 and has its lower run arranged frictionally to engage the crown of a staple stick S on the rail 4 and also the crown of a staple stick S in the magazine which is aligned with the rail 4. In FIG. 1, three staple sticks are visible; a partly consumed stick S1 on the rail 4; a complete stick S2 the leading end of which is on the rail, the remainder being still in the magazine; and the stick S3 which is next to the stick S2 in the magazine. As seen best in FIG. 2 the staples are supported on the rail 4 with their crowns resting on top of the rail and their legs embracing the rail. The belt 20 engages the outside of the crown of the staple stick, the profile of the crown-engaging face of the belt being matched to that of the crown.

The belt may be made of any suitable material capable of exerting the necessary frictional force on the staples. The belt may thus be made of a natural or synthetic elastomer such as a soft grade of polyurethane. More particularly it may, by way of example, be a polyurethane elastomer of the formulation 0503 as sold by American Roller Co. of Union Grove, Wis., U.S.A. In another form the belt may be formed of rubberized fabric such as that sold by Lewis & Taylor Ltd. under the trade name "Minacord." The belt surface may be smooth or, as in the case of the rubberized fabric described, rough in texture.

The belt may be driven continuously or intermittently as by a motor M driving the roller 21. It will be realized that while it is required that a minimum force be applied by the belt to the staple stick in the feed direction in order to effect feeding and biasing of the staples, it is also important to limit the force below that which will cause buckling and skewing of the staple stick and/or sticking of the driver. This is achieved by suitable control of the frictional force between the belt and the staple stick, having regard to the friction qualities of the belt and the stick, so that the belt will slide over the stick while biasing the stick into stapling position. Thus, the rollers 21, 22 may be fixed to define a fixed throat between the belt and the staple rail, or the required belt to stick loading may be achieved by the use of sprung mountings for the rollers. If the belt is driven intermittently, being actuated by movement of the driver for example, the belt drive should index the belt by an amount at least sufficient to position the next staple beneath the driver, yet maintain the biasing force on the staple stick when switched off. For this purpose the belt drive may include a one-way clutch.

Instead of limiting the biasing force applied to the staple stick in the manner described above, force limiting means may be provided in the belt drive. Thus in alternative embodiments the motor M is an impedance limited motor or is connected to the roller 21 through a slip clutch.

Figure 3:
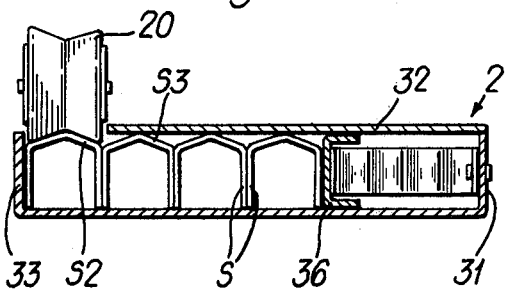
FIG. 3 shows a staple magazine for the stapler of FIG. 1.
Figure 6:
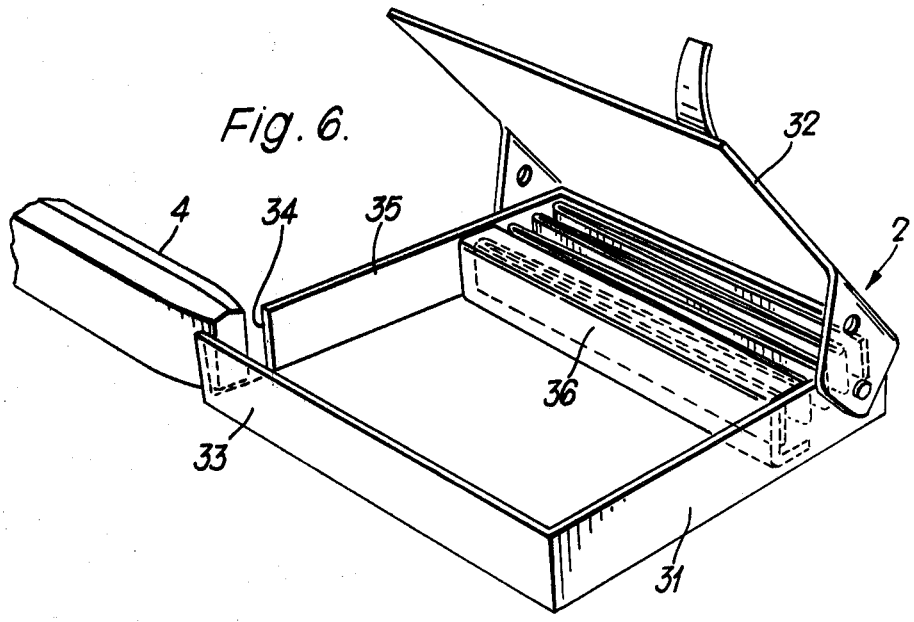
FIG. 6 shows a construction of staple magazine.

The magazine 2, which is seen best in FIGS. 3 and 6, comprises a shallow tray 31 having a lid 32. Staple sticks S are loaded in the tray supported on their legs in the manner shown in FIG. 3 and biased against tray end wall 33 by a spring loaded pusher 36. A gap 34 in the tray side wall 35 is aligned with the stick S2 adjacent the wall 33, and the rail 4. The lid 32 is hinged to permit reloading of the magazine and in order to avoid interference with the staple feeder 3 (not shown in FIG. 6) is shorter than the tray so that it does not overlie the staple stick S2.

In a preferred embodiment, a stapler as described above is adapted to operate with ½-inch crowned staples having legs ⅜-inch long and provided in 4 inch long sticks. The belt 20 is of soft polyurethane and extends over ¾-inch diameter rollers having their centers 4 inches apart. The belt is slightly wider than the staples. The belt is spring loaded against the stick to produce a force in the feed direction of between 2 Newtons and 8 Newtons, preferably 4.45 Newtons. The belt is driven intermittently in response to operation of the driver 1; each time it moves by an amount greater than is necessary to index the stick by one staple - this ensures that any gaps at breaks in the staple stick or between staple sticks are closed up. In addition to this automatic, intermittent operation of the belt, provision may be made for continuous operation of the belt under control of an operator for loading an empty stapler.

Figure 4:
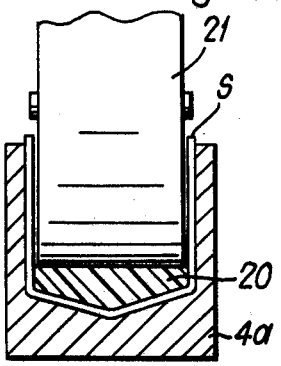
FIG. 4 is a cross-sectional view like that in FIG. 2 of a modified stapler.
Figure 5:
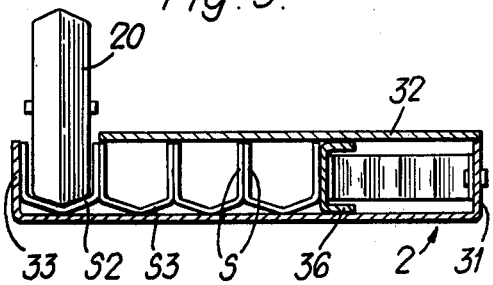
FIG. 5 shows the manner of loading the staple magazine for the modified stapler of FIG. 4.

FIGS. 4 and 5 illustrate features of another embodiment of stapler in accordance with the invention. This stapler is like that described above, except that the stapler head is inverted and the staples are fed thereto upside down along a channel shaped rail 4*a*. The belt 20*a* has a convex profile and engages the insides of the staple crowns. The magazine is like that described previously but the staple sticks are loaded into it upside down.

It will be understood that whilst particular embodiments have been described, various modifications may be made to the specific details referred to herein without departing from the scope of the invention as defined in the appended claims. For example, the stapler may be for use with staples having flat crowns. Further, the magazine may be of the gravity feed type. The belt may be longer or shorter than shown—it may be for example extend from adjacent the driver to or near the back of the magazine and may include intermediate idler or driven rollers.

What is claimed is:

1. A stapler including a driver, a magazine for holding sticks of staples, and a staple feeder for feeding staple sticks from the magazine to the driver and biasing the stick into position for stapling, said feeder comprising:

an endless belt arranged frictionally to engage the crown of said stick with said belt being arranged to slide on a staple stick while continuing to bias the stick into a stapling position; and means for driving said belt, said driving means including means for limiting the force applied in the feed direction so that said belt will stall while continuing to bias the stick into position.

2. A stapler according to claim 1 in which the belt drive means includes an impedance limited motor.

3. A stapler according to claim 1 in which the belt drive means is operative to drive the belt intermittently.

4. A stapler according to claim 3 in which the belt drive is actuated in response to operation of the driver.

5. A stapler according to claim 1 including a rail for supporting the inside face of the staple stick crown and the belt engages the outside face of the crown.

6. A stapler according to claim 1 in which the belt is made of rubberized fabric.

* * * * *